United States Patent [19]

Rinas

[11] Patent Number: 4,890,957

[45] Date of Patent: Jan. 2, 1990

[54] CABLE LAYING APPARATUS

[76] Inventor: David E. Rinas, 4618-35th Street, Lloydminster, Saskatchewan, Canada, S9V 1S9

[21] Appl. No.: 239,869

[22] Filed: Sep. 2, 1988

Related U.S. Application Data

[63] Continuation-in-part of Ser. No. 829,914, Feb. 18, 1986, abandoned.

[51] Int. Cl.[4] ..... E02F 5/10; B65H 49/02

[52] U.S. Cl. ..... 405/174; 405/180; 242/110; 242/110.2; 242/115; 242/116

[58] Field of Search ..... 405/154, 174–178, 405/180, 183; 242/54 R, 77, 110, 110.1–110.3, 115, 116

[56] References Cited

U.S. PATENT DOCUMENTS

| | | | |
|---|---|---|---|
| 2,370,868 | 3/1945 | Luebke | 242/110.2 |
| 2,839,258 | 6/1958 | Jacobson | 242/110.2 |
| 3,047,250 | 7/1962 | Saether | 242/77 |
| 3,232,358 | 2/1966 | Heiberg | 405/180 X |
| 4,221,347 | 9/1980 | Hill | 242/110.2 |
| 4,397,585 | 8/1983 | Fouss et al. | 405/183 |
| 4,744,696 | 5/1988 | Vidler | 405/180 |

*Primary Examiner*—Randolph A. Reese
*Assistant Examiner*—John A. Ricci
*Attorney, Agent, or Firm*—Adrian D. Battison; Stanley G. Ade; Murray E. Thrift

[57] ABSTRACT

A method and apparatus for laying cable at an obstruction comprises a collapsible reel, an unwind guide and a rewinding device. The reel is removable from the laying vehicle when it reaches the obstruction and has an end flange which can be removed and radially collapsible surface segments which allow the inner end of the cable to be found and withdrawn, passed through an excavation under the obstruction and rewound onto a new reel. In one arrangement, the rewind device is arranged to introduce a twist into the cable in a direction opposite to that inserted by the unwinding. In this case the rewind device includes an arm rotatable around a stationary reel with traverse means for wrapping the cable onto the reel in similar manner from that which it is withdrawn from the first reel. In a second arrangement the twisted cable is wound onto the new reel and then is withdrawn from the reel in a manner which ensures it is laid without twist.

8 Claims, 10 Drawing Sheets

CABLE LAYING APPARATUS

This application is a continuation-in-part of U.S. patent application Ser. No. 829,914 filed Feb. 18, 1986 and now abandoned.

BACKGROUND OF THE INVENTION

This invention relates to a method of laying cables and to various apparatus designed for use with the method, specifically a modified reel for supporting the cable supplied, an unwind guide and a rewind device for rewinding cable drawn from the supply.

The underground laying of cable is a well known technique and has been used for many years to lay electrical and other cables. Often this can be accomplished by simply drawing a plow type device through the ground at the required depth and feeding the cable from a lower end of the plow type device into the ground so that as the plow is drawn along the ground the cable is left under the ground at the required depth. This generally avoids the necessity for digging a trench and a subsequent refilling of the trench.

Such a technique is very effective particularly in areas where there are very few restrictions so that the cable can be layed effectively continuously without halting the technique for roads or railway tracks or other similar obstructions.

Fiber-optics cables have become technically important in recent years and programs are currently under way to lay large lengths of these cables in view of the improved technical performance they provide relative to standard copper cables. However, a serious problem in relation to such cables is the difficulty and expense of splicing cables and hence it is essential to lay the cable in as long a length as possible regardless of any obstructions. The above technique, therefore, is seriously disadvantaged in that it is necessary to halt laying at each obstruction and to provide a technique for overcoming the obstruction and continuing laying on the other side of the obstruction.

Generally this has been carried out by stopping the laying vehicle at the obstruction and unrolling all of the remaining cable on the supply reel into a long loop pulled back in the direction of the previously layed material. When the reel is emptied and the end of the cable found, this is then passed through a bored hole under the obstruction and the laying vehicle transfers to the other side of the obstruction and continues laying while pulling the cable back from the long loop layed out over the ground. This technique is seriously disadvantageous in that the cable is exposed to potential damage by being layed out in an unprotected fashion, secondly it is time consuming and difficult to draw out the cable into the necessary long loop and thirdly the tensions in the cable vary considerably during the pulling out of the loop and also the laying in the ground. This is particularly serious in relation to fiber-optics cables which have a limited resistance to longitudinal tension.

SUMMARY OF THE INVENTION

It is one object of the present invention therefore to provide an improved method and associated apparatus for laying cables of this type at an obstruction.

According to a first aspect of the invention there is provided a method of laying a cable in the ground from a supply reel of the cable on which the cable is wound in revolutions around the reel from an inner end outwardly to an exposed outer end, the method comprising transporting the supply reel across the ground, on a transport vehicle withdrawing cable from the outer end on the supply reel so as to unwind from the reel, laying the withdrawn cable in a first laying step continuously in the ground along a path followed by the transport vehicle, up to a position adjacent an obstruction, halting the unwinding of cable at the obstruction, excavating an opening to pass the obstruction, removing the supply reel from the vehicle, extracting and withdrawing the inner end of the cable from the reel, passing the inner end through the opening, unwinding cable from the reel with the inner end of the cable leading such that, as the cable unwinds, one turn of twist is inserted into the cable for each revolution unwound, attaching the inner end of the cable onto a second reel positioned downstream of the obstruction, and rewinding the cable onto the second reel as it unwinds from the supply reel, attaching the second reel to the transport vehicle so as to be transported across the ground, withdrawing cable from the second reel, laying the withdrawn cable in a second laying step in the ground along a path followed by the transport vehicle carrying the second reel from the obstruction, and arranging the direction of winding of the cable onto the second reel relative to the direction of unwinding of the cable from the supply reel at the obstruction and relative to the direction of unwinding of the cable from the second reel as it is transported in the second laying step such that the cable is free from twist as it is laid.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
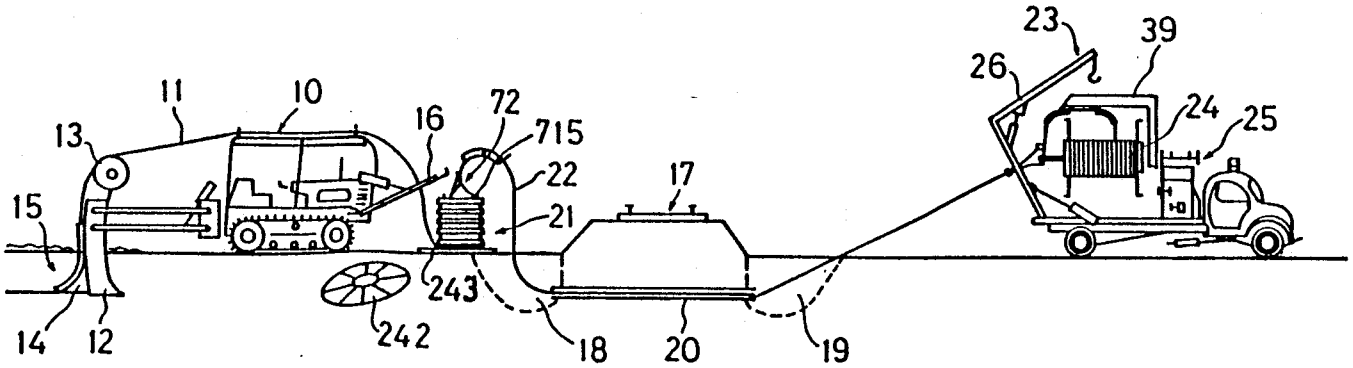
FIG. 1 is a schematic side elevational view of a method and apparatus according to the invention showing the laying of a cable adjacent an obstruction.

Turning firstly to FIG. 1 there is indicated at 10 a suitable and conventional vehicle for laying a cable 11 including a plow 12 which is drawn through the ground by the vehicle. The cable is fed from a supply reel over a pulley 13 and through a guide 14 to be layed at an underground location 15. The details of this machine are of a conventional form and therefore need not be described herein in detail.

The reel is normally supported on support arms 16 rearwardly of the vehicle 10 so the vehicle can simply travel across the ground withdrawing the cable from the outer surface of the reel or drum and supplying it into the channel form by the plow 12.

An obstruction is shown generally at 17 which in this example is schematically shown as a railway line at which a pair of excavations 18 and 19 are formed on either side of the obstruction at a position in line with the intended line of the cable. A bore or opening 20 is then formed under the obstruction from one excavation to the other.

On the vehicle 10 reaching the excavation on the near side of the obstruction, the reel indicated at 21 is removed from the vehicle and collapsed as explained hereinafter so that the inner end of the cable 22 can be withdrawn from the inside of the drum and the end passed through the bore 20 to a rewind machine indicated at 23. The rewind machine then acts to withdraw the cable from the collapsed reel 21 and rewind it onto a fresh reel 24 down stream of the obstruction.

The rewind unit is shown mounted upon a truck 25 including a crane 26 for lifting the reel so that when fully rewound the reel 24 can be replaced upon the vehicle 10 on the down stream side of the obstruction and the laying continued with the reel 24 mounted on the arm 16 of the vehicle.

Figure 2:
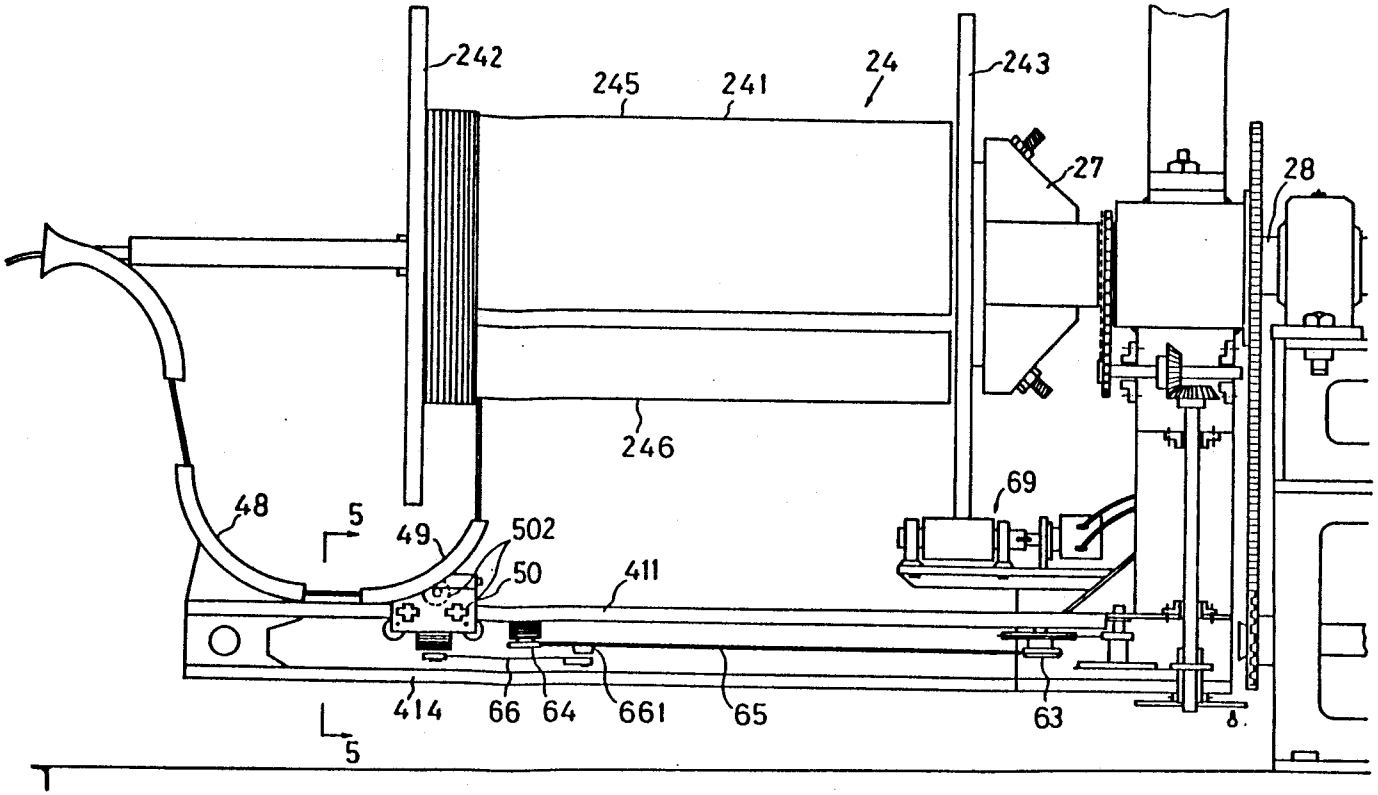
FIG. 2 is a side elevational view of the rewinding device of FIG. 1 on an enlarged scale.
Figure 3:
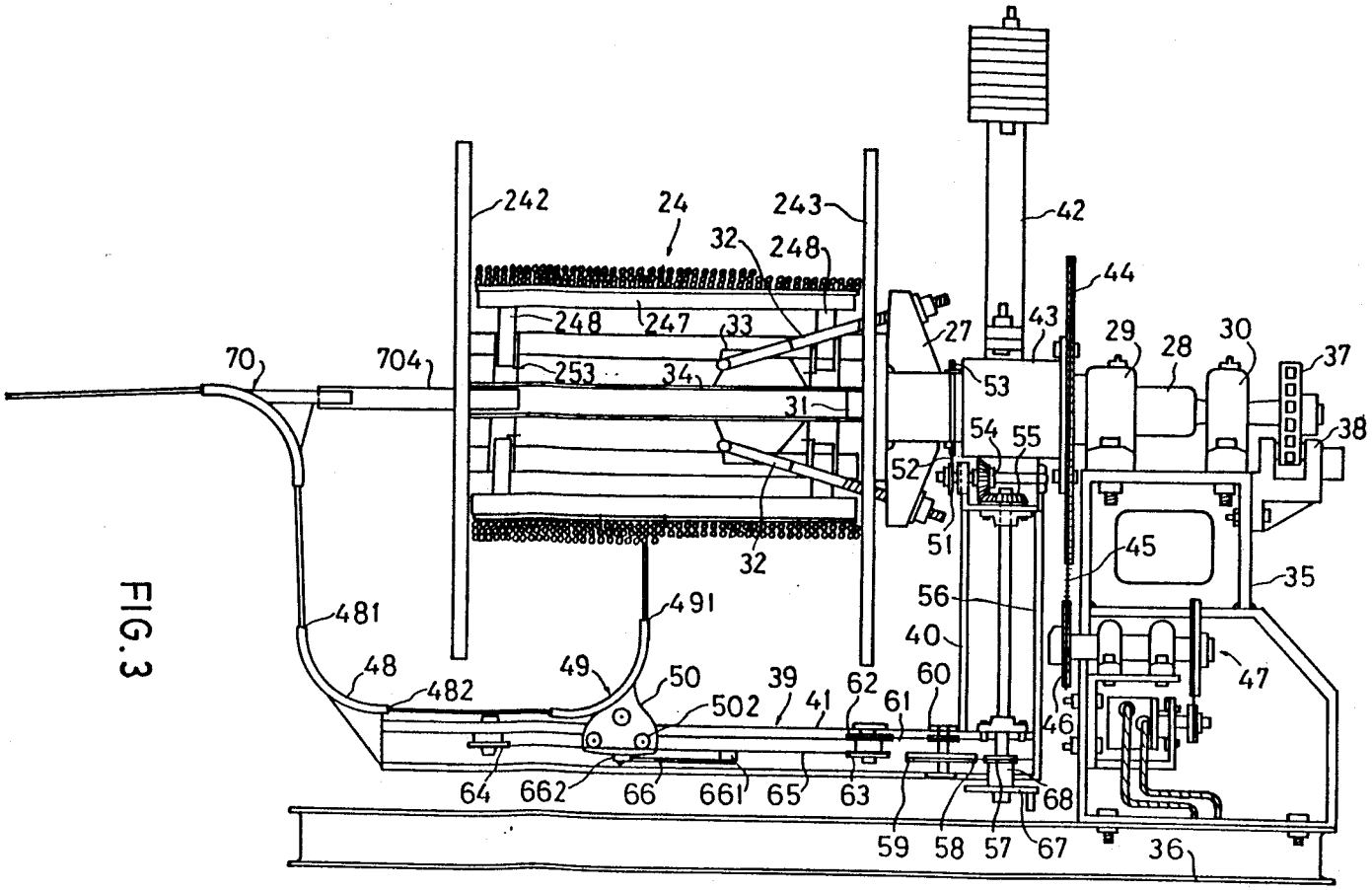
FIG. 3 is a side elevational view partly in cross-section of the rewinding device of FIGS. 1 and 2 in a different winding mode.

Turning now to FIGS. 2 and 3 the rewinding device 23 and the second reel 24 are shown in more detail. Particulary the rewinding device defines a mandrel 27 carried upon a shaft 28 mounted in bearings 29 and 30. The mandrel 27 carries the reel 24 by way of a central stud 31 and tie rods 32. The stud 31 projects into a central tubular portion 34 of the reel body of the reel 24. On outer faces of the tubular portion 34 are mounted a plurality of wedge members 33 to which one end of each of the tie bars respectively is coupled by way of a hook portion. The outward end of each of the tie bars 32 is bolted at a radially outwardly spaced position on the mandrel 27 to provide a complete latching action so that the reel is held cantilevered out from the bearings 29, 30.

The bearings 29, 30 are mounted upon a frame generally indicated at 35 which in turn is carried upon a chassis 36 for mounting upon the vehicle 25.

The end of the shaft 28 remote from the reel 24 carries a clutch plate 37 which can be grasped by a caliper 38 carried on the frame 35 to hold the shaft 28 and thus the reel 24 in a stationary position when required. The caliper 38 can also be released to allow rotation of the reel as will be explained hereinafter.

A winding arm generally indicated at 39 comprises a radial portion 40 and an axial portion 41 which extends parallel to the axis of the reel outside of the reel for rotation around the axis of the reel. The radial portion 40 is mounted upon a bearing 43 for rotation around the shaft 28. Driving force to the hub 43 is obtained via a chain wheel 44 from a chain 45 driven by a sprocket 46. The sprocket receives motive force from a motor arrangement generally indicated at 47.

The end of the arm portion 41 remote from the hub 43 carries a stationary guide 48 which includes an entry end 481 facing radially inwardly toward the axis of the reel. An exit end 482 of the guide 48 is arranged to project the cable axially along the arm portion 41 toward a traverse guide 49. The traverse guide 49 includes an entry end in line with the exit end 482 to receive the cable without any distortion thereof. An exit end 491 of the guide 49 is directed toward the reel and in practice will take up a direction tangentially of the reel as required by the winding portion of the cable.

Figure 5:
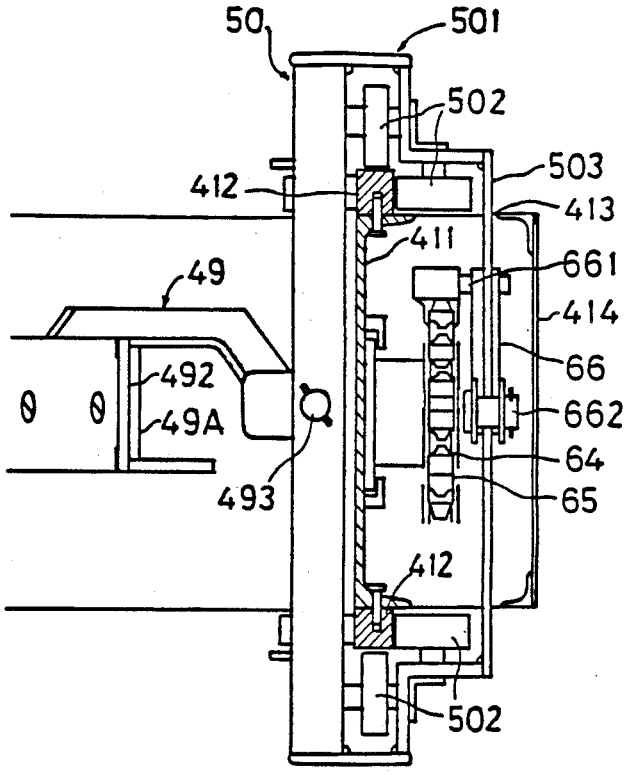
FIG. 5 is a cross-sectional view of the rewinding device of FIGS. 2, 3 and 4 taken along the lines 5—5 of FIG. 2.

The traverse guide 49 is shown in more detail in FIG. 5 and defines a channel 49A for receiving the cable and having an inner curved wall defined by a teflon layer 492 over which the cable runs. It will be appreciated that the guide 49 and other guides in this system have a radius of curvature suitable for the specification of cable concerned to avoid deforming the cable in its winding movements. In order to provide the required angle of the guide 49 which is dependent upon the number of layers of cable applied to the reel 24, the guide 49 is pivotal about a pivot mounting 493. The pivot mounting 493 is mounted upon a carriage 50 which is slidable along the arm portion 41. Thus the carriage 50 includes a frame 501 which supports a plurality of rollers 502 which are positioned to roll along rails 412 of a channel section 411 of the arm 41. The arm 41 is defined by the channel section 411 and a front plate 414 which defines a slot 413 along the reqired length thereof for receiving a front face 503 of the carriage 50. Thus the carriage 50 is constrained to move back and forth along the arm 41 to provide the necessary traverse movement to lay the cable in side by side wraps.

The motive force for the carriage 50 is provided from a sprocket 51 driven by a chain 52 from a sprocket 53 carried by the shaft 28. Thus each rotation of the sprocket 51 around the shaft 28 introduces a number of rotations into the sprocket 51 about its own axis. This drive to the sprocket 51 can be accomplished either by rotation of the arm 39 around the shaft 28 or by rotation of the shaft 28 while the arm 39 is held stationary.

From the sprocket 51 drive is communicated through a shaft 54, bevel gear arrangement 55, shaft 56, sprocket 57, chain 58, sprocket 59, sprocket 60, chain 61 to a sprocket 62. The sprocket 62 is mounted on the same shaft as a drive sprocket 63 which cooperates with an idler sprocket 64 at an opposed end of the arm portion 41. The drive sprocket 63 and idler sprocket 64 carry a chain 65 which extends along the full length of the arm portion 41 and is constrained to move around the sprockets in conventional manner.

The chain 65 carries a rigid link 66 which is pivotally coupled at a front end through a pin 661 to the chain. A rear end of the link 66 is coupled by a pivot coupling 662 to the front face 503 of the carriage 50. Thus, as the chain moves along the arm portion 41 toward the drive sprocket 63 it draws with it the carriage 50 and thus the traverse guide 49. At the sprocket 63, the pivot coupling 661 of the length 66 moves around the sprocket with the chain thus defining a dwell at the sprocket 63 dependent upon the diameter of the sprocket 63. The length of the link 66 and the position of the sprocket 63 are of course positioned so that the traverse guide 491 properly reaches an end of the reel 24 at which reversal of the winding direction is required. As the chain carries the coupling 661 back along the arm portion 41 it pushes the carriage 50 along the arm 41 toward the guide 48. This causes the winding direction to move in a right to left direction until the pivot coupling 661 reaches the idler sprocket 64 at which the traverse again reverses in direction.

Winding of the reel can thus be accomplished by retaining the reel stationary while the arm rotates continually around the reel with the traverse operating as above stated. The speed of traverse of the guide 49 is automatically compensated taking the drive from the rotation of the arm 41 as previously explained.

After winding is complete and when a fresh reel 24 is applied to the mandrel, the position of the traverse guide 49 and the carriage 50 can be positioned at one end flange simply by disconnecting a drive clutch 68 and manually cranking a hand lever 67 to directly move the chain 65 and the guide 49.

A counter balance arm 42 is coupled to the hub 43 at a radially opposed position to the arm 39 solely for purposes of balance.

Figure 4:
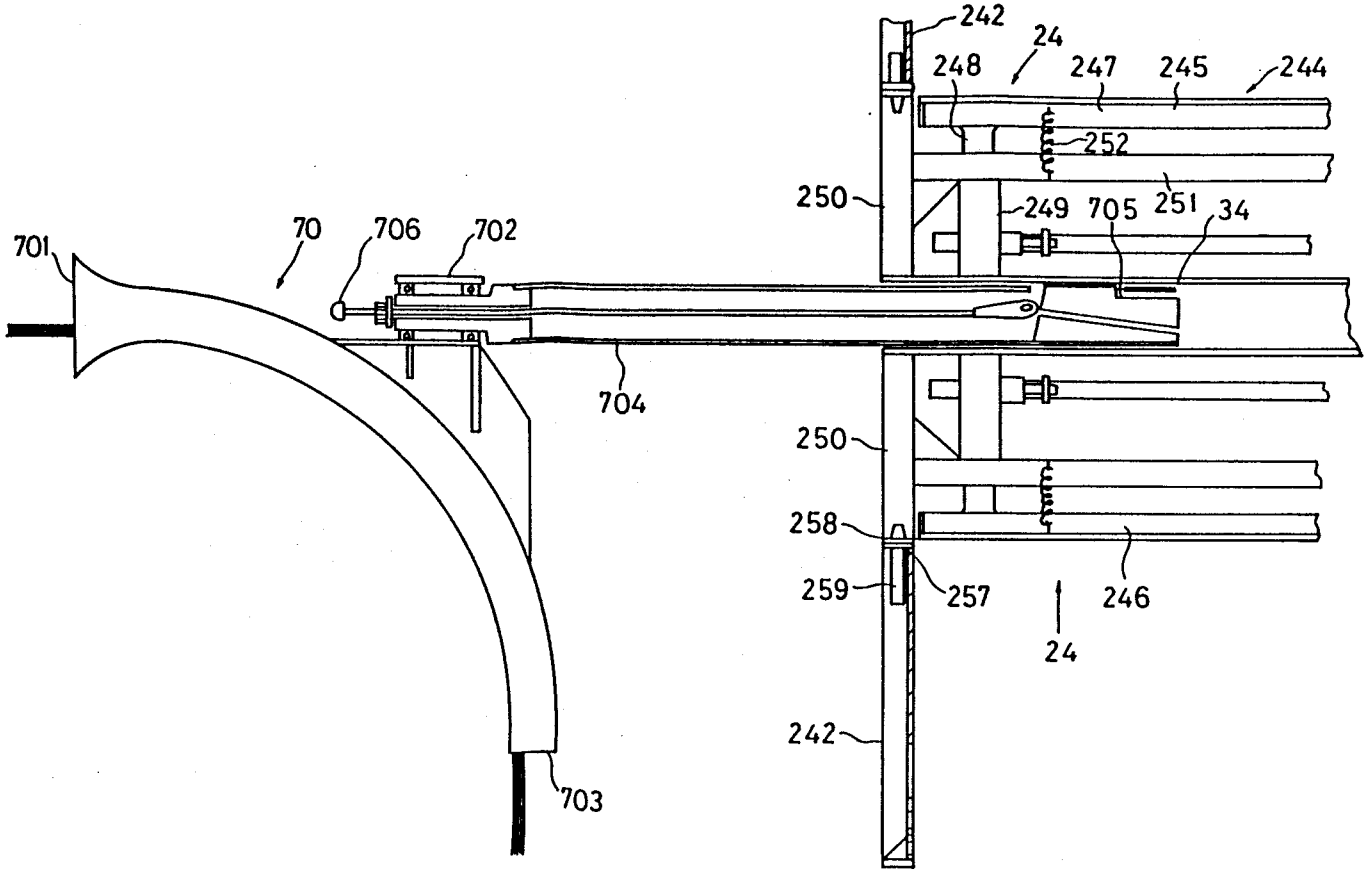
FIG. 4 is a cross-sectional view of FIGS. 2 and 3 on an enlarged scale of part of the rewinding device.

Turning now particularly to FIG. 4, an incoming guide 70 is mounted axially of the reel. The guide 70 is basically the same construction as the guides 48 and 49 and is mounted with an inlet 701 directly on the axis of the reel. An outlet end of the guide 70 indicated at 703 can freely rotate around the axis on bearings 702 to take up a required position to transmit the cable directly to the inlet end 481 of the guide 48. The bearings 702 are mounted upon a shaft 704 which can be coupled into the tubular portion 34 of the reel body by a wedge arrangement 705 actuated by a screw 706. Thus the shaft 704 is held directly axial and properly mounts the inlet end 701 of the guide on the axis so that it receives the cable and holds the cable at that point to prevent any whipping of the cable as the arm 39 is rotated around the reel axis.

It will be appreciated that each rotation of the arm around the reel axis acts to insert one turn of twist into the cable at the inlet end 701 of the guide 70 since the loop portion of cable between the reel and that inlet end is cranked around the inlet end in a twisting action. The direction of twist is of course dependent upon the direction of rotation of the arm around the reel.

The construction of the reel is best shown in FIGS. 3, 4, 6 and 7. The reel comprises a cylindrical surface portion 244 and a pair of end flanges 242 and 243. The cylindrical surface is formed by three separate surface portions 245, 246 each of which constitutes an arc of the cylinder of the order of 120°. Each surface portion is carried on a square tube 247 which is in turn mounted upon a pair of tubular pegs 248 which extend in a radial direction. The tubular pegs 248 can slide within sockets 249 so that each surface portion can move directly radially so as to increase and decrease the radial dimension of the surface 244 so defined.

The reel body defined by the central tube 34 carries spokes 250 at respective ends thereof which are interconnected by axial struts 251. The sockets 249 are carried between the struts 251 and the central tube 34 and define an open face on the outer surface of the struts 251 into which the pegs 248 can slide. The surface portions are biased into a radially inward position by springs schematically indicated at 252.

Figure 7:
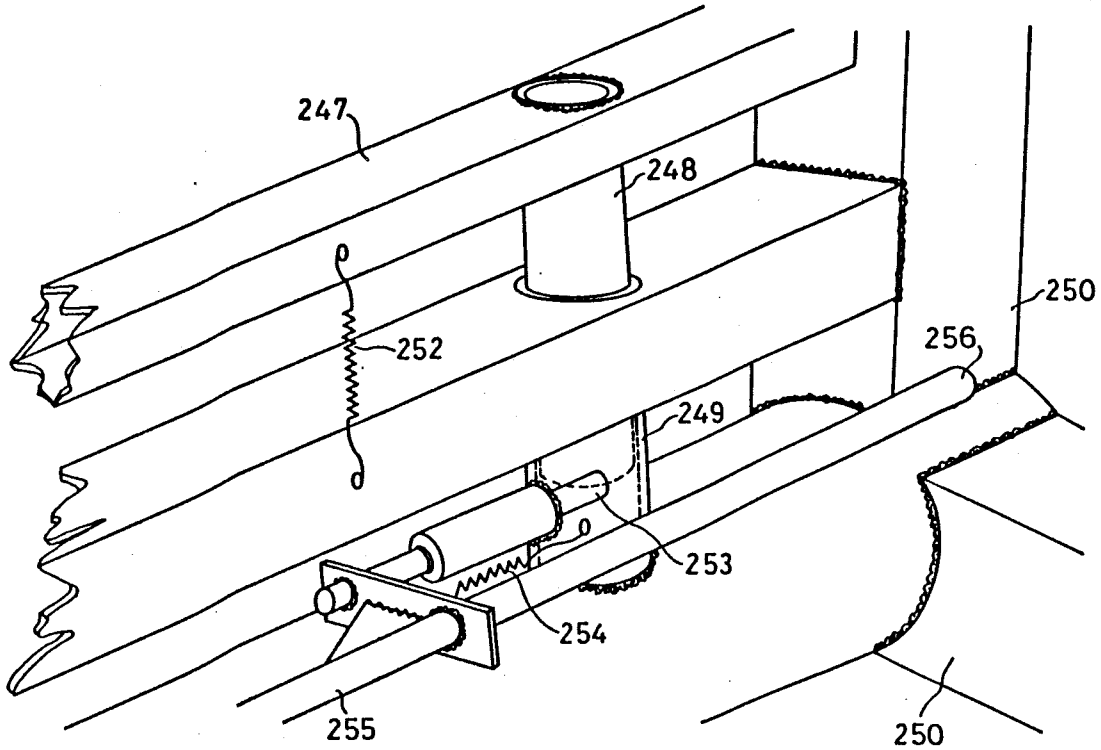
FIG. 7 in an isometric view of part of the reel of FIG. 6 on an enlarged scale.

The surface portions can be latched into a radially outer position by pins 253 shown best in FIG. 7 and indicated only schematically in FIG. 3. Each of the pins 253 project into a respective socket 249 for engaging an end face of the tubular peg 248 to hold the tubular peg in the outermost position. The pins 253 of a respective one of the surface portions can be actuated by a rod 255 which slides longitudinally of the reel when hammered by a blow to an exposed end 256. A spring 254 biases the shaft 255 and therefore the latches 253 into a latched position.

Thus the surface portions can be moved into the radially outer position simply by manually drawing the respective portion away from the reel axis until the latch pin 253 drops into the latched position. When it is required to collapse the reel by reducing the diameter of the surface portions, this can be achieved simply by hammering the rod 255 at which time the springs 252 immediately draw the surface portion inwardly as soon as the latch pin 253 is removed from its latched position.

Figure 6:
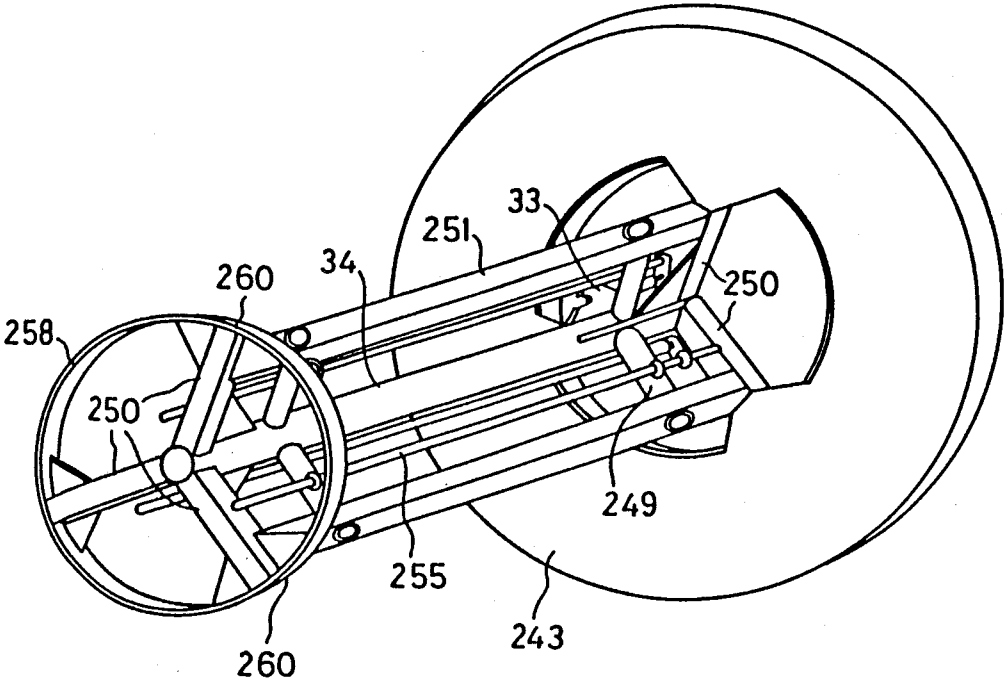
FIG. 6 is an isometric view of the reel shown in FIGS. 3 and 4 with the surface segments and end flange removed.

The end flange 242 as best shown in FIG. 4 comprises an annular flange portion forming an inner face for engaging the end most wraps of cable with a cylindrical band 257 forming a radially inwardly facing surface of the end flange. This surface 257 is arranged to directly overlie a cylindrical band 258 of the reel body carried on the outer ends of the spokes 250 at the respective end of the reel body. The bands 257 and 258 can be interlocked by three radial pins 259 which engage into openings 260 in the band 258 at respective ones of the spokes 250. The pins 259 can be locked into position by conventional split pins either in the unlocked or the locked positions so as to hold the end flange 242 securely in the fixed position as shown in FIGS. 3 and 4 or in the removed position as shown in FIGS. 1, 6 and 8.

Figure 8:
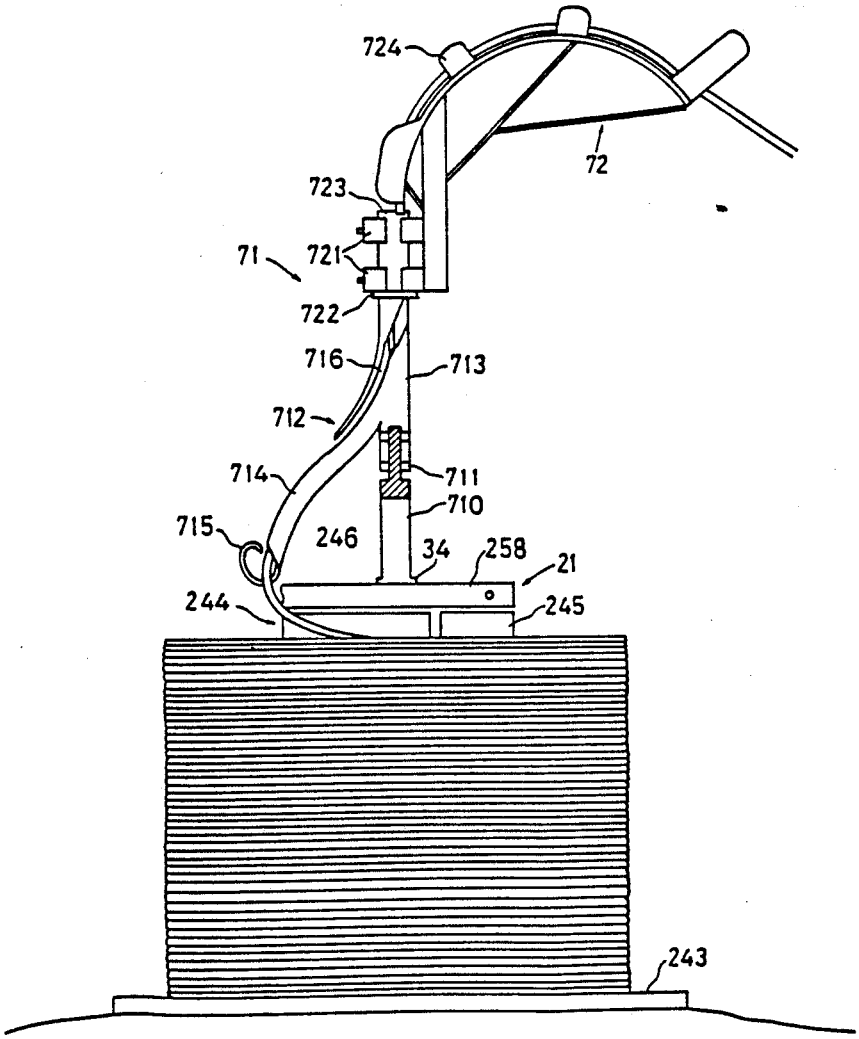
FIG. 8 is a side elevational view of the reel of FIGS. 1, 4, 6 and 7 and including the unwinding guide of FIG. 1.

Turning now to FIGS. 1 and 8, there is shown an unwinding guide for the collapsed reel 21 while the cable is unwound from the inner end outwardly. The unwinding guide is generally indicated at 71 and includes a central mast portion 710, a rotatable guide portion 712 and a generally stationary guide portion 72. The stationary mast portion 710 is mounted in the end of the tubular portion 34 of the reel body in a similar manner to the shaft 704 of FIG. 4. The stationary mast 710 carries an upright portion 713 of the rotatable guide 712 on bearings 711. The rotatable guide 712 includes a guide channel 714 and a loop member 715 at a lower most end thereof. The loop member 715 is positioned so that it just clears the outer edge of the band 258 so that as the cable is drawn from the inner wraps of the wound cable away from the surface 244 it is held from rubbing against the band 258 or snagging between the portions 245, 246 by the loop 715. From the loop the cable passes along the teflon coated curved guide 714 to a slot 716 which extends spirally of the upstanding rotatable portion 713. This slot allows the cable to enter into the central axis of the upstanding portion 713 to emerge out of an opening at the upper end thereof.

From the upper end of the portion 713, the cable passes over an outer or upper face of the stationary guide 72 between upstanding pairs of lugs 724. The cable initially extends generally upwardly and then turns out toward one side of the reel so that it can properly move toward the opening 20 as shown in FIG. 1. The position of the stationary guide 72 automatically adjusts to take up the required position of the cable. In order to achieve this the stationary guide 72 is rotatably mounted on the upper end of the upstanding portion 713 so that as the portion 713 rotates, the stationary guide 72 remains effectively stationary. The rotational mounting is obtained by a pair of collars 721 which substantially surround the upper end and act as bearings. An end flange 722 engages one end of the lower bearing 721 to prevent axial movement of the collars 721. Each of the collars 721 includes a slot 723 so that the whole of the stationary guide can be removed from the cable after unwinding is complete. The slots 723 are arranged in line so that the spiral slot 716 does not cross the slots 723 simultaneously thus avoiding any tendency of the cable to jump out of the slots which could occur if they lined up at any time during the rotation.

As shown in FIG. 1, the rotatable guide includes two such wire loops 715 at angularly spaced positions around the axis of the reel so as to accommodate rotation around the reel in either of the two possible directions dependent of course upon the direction of winding of the cable on the reel.

As the cable rotates around the reel in its unwinding motion, a turn of twist is introduced into the cable for each rotation of the crank defined by the guide 712 around the reel axis.

In order to remove this twist before the cable is rewound onto the reel 24, the arm 39 rotates similarly but in an opposite direction so as to counteract each turn of twist. The numbers of turns of twists are automatically compensated by the fact that as the cable is withdrawn from the inner end of the reel 21 it is rewound onto an exactly similar position on the reel 24 provided the winding parameters are properly set to provide duplicate reels.

The end flange 242 carries a conventional end trap for the cable so that winding can always be commenced at the end flange 242. In this way, when the end flange 242 is removed, the end of the cable is automatically found and can be passed through the opening 20 for winding at the end flange 242 of the reel 24.

When the winding of the cable is complete, it will be appreciated that the cable extends from the reel 24 through the opening 20 to the cable portion 11 on the laying vehicle 10. At this time the guide 72 can be unthreaded from the cable leaving a short loop which, if properly managed, can simply be buried in the excavation 18. Some excavation work may be necessary to complete the burying of the cable between the laying point 14 and the excavation 18 depending upon the position at which the laying vehicle ceased laying adjacent the obstruction.

The vehicle 25 can then be actuated using the crane 26 to replace the reel 24 on the arms 16 of the laying vehicle 10 following which the reel 21 is reassembled and placed in position on the mandrel 27 of the vehicle 25. The vehicle 25 can then move to the next obstruction for the process to be repeated when the laying vehicle 10 approaches or reaches the obstruction.

If the winding assembly 23 on the vehicle 25 is required for initial rewinding of cable from a conventional supply reel onto the special reel of the present system, this can be accommodated by holding the arm 39 stationary by a suitable mechanism (not shown) and by driving the reel 24 by a frictional drive member 69 against the end flange 243. In such a case there is no rotation of any crank of cable around the axis and hence no twist is introduced.

It will of course be appreciated also that in order to twist the cable as it is wound onto the reel 24 in a direction to remove the twist introduced by the unwinding from the reel 21, it is necessary to wind the cable onto the reel 24 in an opposite direction to that in which it was wound onto the reel 21. Thus the reels as they are used alternately have opposite directions of winding. Thus there is provided means for rotating the arm 39 in either direction as required and also there is provided the symmetrical unwinding guide which accommodates both directions of unwinding.

Turning now to FIGS. 9 through 12, there is shown an alternate method using the technique of the invention.

Figure 9:
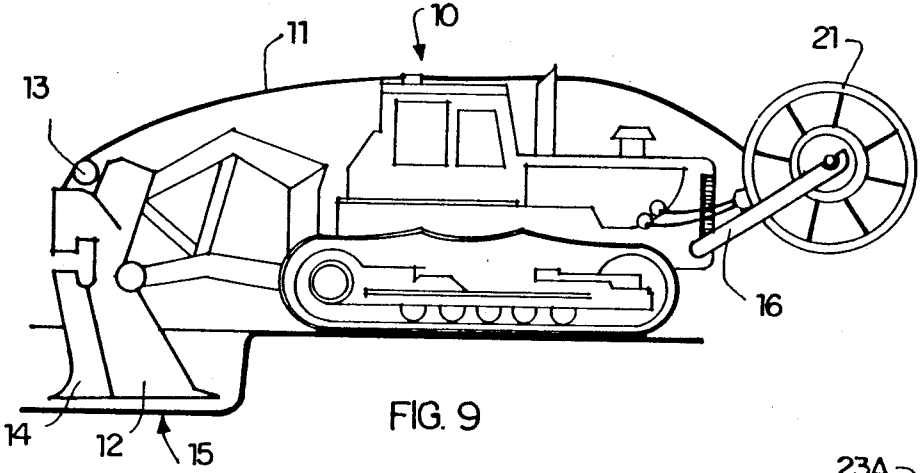
FIGS. 9, 10, 11 and 12 show the sequential steps of an alternate method using the technique of the present invention.

In FIG. 9 there is shown the conventional vehicle of FIG. 1 and in this case it will be noted that the reel 21 is mounted on the vehicle so that it unwinds to one side while the reel is rotated so that no twist is inserted into the cable as it is directly drawn off to one side of the reel. Laying of the cable is carried out as previously described.

Figure 10:
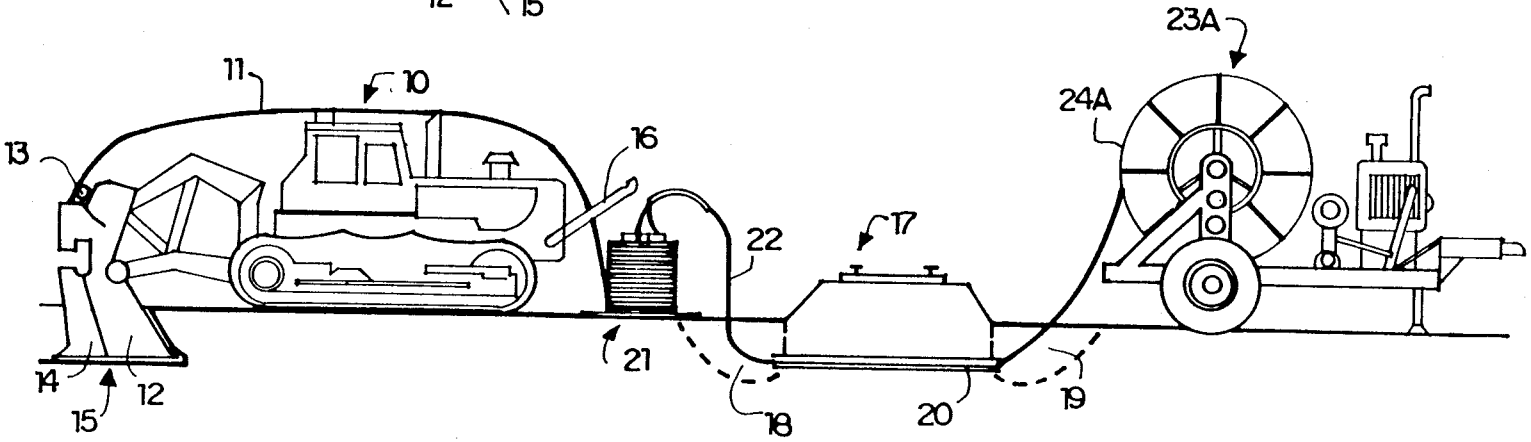

At the obstruction as shown in FIG. 10, the reel is collapsed as previously described and the free or inner end of the cable withdrawn and passed through the opening 20 as previously deacribed. In this modification, however, the cable is wound onto a further reel 24A mounted upon a winding vehicle 23A. In this case the winding vehicle and the reel are arranged so that the winding action is carried out by rotation of the reel with the cable being fed onto the reel from one side so that no twist is inserted or counteracted by the winding of the cable onto the reel 24A.

It will be appreciated therefore that the winding of the cable onto the reel 24A takes place so that the twist in the cable inserted by the unwinding overend from the collapsed reel 21 is still maintained in the cable as it lies on the reel 24A.

The modified method has the advantage that the winding of the cable onto the reel 24A can be carried out much more rapidly in view of the fact that the reel itself is rotated as oppposed to the arm of the previous device in which case the rotation can be significantly increased in speed. Furthermore the winding device 23A is of a conventional nature and of a relatively simple construction thus avoiding the necessity for manufacture or purchase of specialized equipment.

Figure 11:
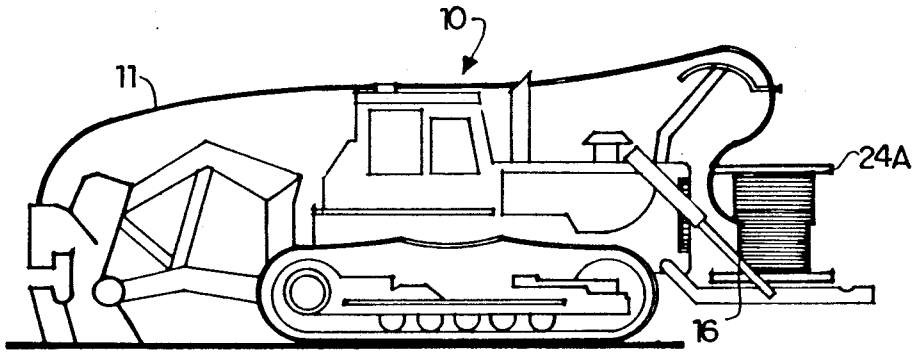

In FIG. 11 is shown the next step in the process in which the newly wound reel 24A is applied to the laying vehicle 10 for continued laying of the cable 11 downstream of the obstruction. In this case, however, the reel 24A is attached to the reel support arms 16 of the vehicle 10 in such a manner that the cable is withdrawn from the reel 24A over end without any rotation of the reel. Thus the reel is mounted in a vertical manner lying on one end flange of the reel. The cable is then withdrawn around the other end flange with the end flange acting as a guide to enable it to be drawn off at the relatively low speed necessary. As the cable is drawn off overend, one twist is inserted into the cable for each revolution of cable withdrawn from the reel. The direction of unwinding determined by the orientation of the reel causes twist to be inserted in a clockwise or counterclockwise direction depending upon the orientation of the reel. The direction of the twist is chosen so that it is opposite to the twist inserted during the step shown in FIG. 10 so that the twist inserted counteracts the twist already in the cable as it lies on the reel 24A so that the cable fed to the plough is free from twist.

Figure 12:
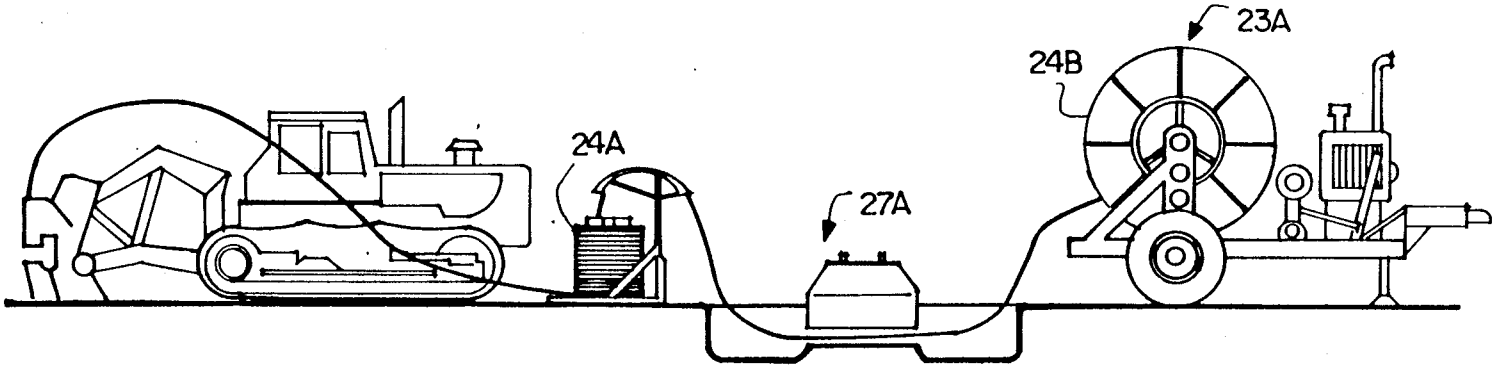

Turning now to the steps shown in FIG. 12, at a next obstruction 17A, the process previously shown in FIG. 10 is carried out in that the reel is collapsed as previously described, the inner end located and fed through the opening under the obstacle 17A and rewound onto a new reel 24B (which may of course be the same reel as the original reel 21). Again the direction of unwinding is arranged to be clockwise or counterclockwise depending upon the twist existing in the cable on the reel 24A so that the turn of twist inserted into the cable by the unwinding for each revolution unwound acts to counteract the twist already in the cable so that the cable as it passes through the opening and is wound onto the reel 24B is free from twist.

After winding is complete the new reel 24B can be attached to the vehicle 10 in the manner shown in FIG. 9 so that the untwisted cable is fed in conventional manner for further laying downstream of the second obstacle and up to the next obstacle following which the cycle is repeated.

It is of course very important that if the cable is withdrawn from the collapsed reel in a clockwise direction then it must be rewound onto the next reel on the rewind machine in a counterclockwise fashion, and vice versa. If this is not done of course then the twist will be added rather than subtracted leading to a highly twisted cable being layed in the ground which of course is not acceptable. The winding in the required direction can be obtained by color coding of the attachment socket into which the end of the cable is inserted at the removable end flange. Thus sockets can be arranged to be directed in the required direction at the removable end flange and color coded so that the operative knows if it is withdrawn from one color it must be attached to the opposite color for the rewinding process. In an arrangement in which only one flange of the reel is intended to be removed and intended to be uppermost in the step of FIG. 11, it is necessary to drive the reel in opposite directions on the rewind machine as indicated by a comparison of FIGS. 10 and 12.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A method of laying a cable in the ground from a supply reel of the cable on which the cable is wound in revolutions around the reel from an inner end outwardly to an exposed outer end, the method comprising transporting the supply reel across the ground on a transport vehicle, withdrawing cable from the outer end on the supply reel so as to unwind from the reel, laying the withdrawn cable in a first laying step continuously in the ground along a path followed by the transport vehicle up to a position adjacent an obstruction, halting the unwinding of cable at the obstruction, excavating an opening to pass the obstruction, removing the supply reel from the vehicle, extracting and withdrawing the inner end of the cable from the reel, passing the inner end through the opening, unwinding cable from the reel with the inner end of the cable leading such that, as the cable unwinds, one turn of twist is inserted into the cable for each revolution unwound, attaching the inner end of the cable onto a second reel positioned downstream of the obstruction, and rewinding the cable onto the second reel as it unwinds from the supply reel, attaching the second reel to the transport vehicle so as to be transported across the ground, withdrawing cable from the second reel, laying the withdrawn cable in a second laying step in the ground along a path followed by the transport vehicle carrying the second reel from the obstruction, and arranging the direction of winding of the cable onto the second reel relative to the direction of unwinding of the cable from the supply reel at the obstruction and relative to the direction of unwinding of the cable from the second reel as it is transported in the second laying step such that the cable is free from twist as it is laid.

2. The invention according to claim 1 wherein the reel includes means defining a cylindrical support surface for supporting the cable, said method including reducing the radial dimension of said surface whereby to allow said extracting and withdrawing of the inner end from the reel.

3. The invention according to claim 1 wherein the reel includes end flanges spaced axially of the reel and arranged in radial planes, the method including removing one end flange so as to allow extracting and withdrawing of said inner end.

4. The invention according to claim 1 including the step of rotatably guiding the cable as it is withdrawn from the supply reel so as to prevent snagging of the cable on the supply reel.

5. The invention according to claim 4 including the step of turning said supply reel onto one end prior to said extracting and withdrawing the inner end, positioning a rotatable guide on an upper end of said reel and passing the withdrawn cable over a stationary guide mast extending upwardly from said upper end and outwardly to one side thereof.

6. The invention according to claim 1 wherein said winding of the cable onto said second reel includes the steps of holding said second reel stationary and rotating a supply arm around the second reel, said supply arm including traverse means for guiding the cable onto said second reel in side by side wraps.

7. The invention according to claim 1 wherein the cable is wound onto the second reel by rotating the reel while feeding the cable from one side of the reel such that the cable is wound onto the second reel while in a twisted condition with the turns of twist inserted into the cable by the unwinding thereof from the supply reel and wherein unwinding of the cable from the second reel in the second laying step takes place over one end of the reel, the direction of winding onto the second reel being arranged such that the over end unwinding of the cable in the second laying step causes a removal of said twisted condition of the cable.

8. The invention according to claim 7 wherein the second laying step is halted at a second obstruction, an opening is excavated to pass the second obstruction, the second reel is removed from the vehicle, the inner end of the cable extracted and withdrawn from the second reel, passed through the opening in the second obstruction and wound onto a further reel without applying twist as the cable is wound onto the further reel.

* * * * *